US007138589B2

(12) United States Patent
Tanaka et al.

(10) Patent No.: US 7,138,589 B2
(45) Date of Patent: Nov. 21, 2006

(54) WIRELESS DEVICE HAVING A BATTERY SELECTIVELY ACTIVATED

(75) Inventors: Yukiomi Tanaka, Takahama (JP); Shingo Yoshida, Ichinomiya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 11/233,265

(22) Filed: Sep. 22, 2005

(65) Prior Publication Data

US 2006/0124439 A1 Jun. 15, 2006

(30) Foreign Application Priority Data

Oct. 7, 2004 (JP) ..... 2004-294738

(51) Int. Cl.
*H01H 27/00* (2006.01)

(52) U.S. Cl. ..... 200/43.04; 200/43.07

(58) Field of Classification Search ..... 200/43.04, 200/43.07, 42.01–43.22, 17 R, 61.62, 333, 200/334

See application file for complete search history.

(56) References Cited

U.S. PATENT DOCUMENTS 5,464,954 A * 11/1995 Kimura et al. ..... 200/61.62
5,622,253 A * 4/1997 Wecke et al. ..... 200/43.07
6,118,087 A * 9/2000 Fukui ..... 200/43.04
6,130,387 A * 10/2000 Bricaud et al. ..... 200/43.04
6,194,674 B1 * 2/2001 Fukui ..... 200/43.04
6,307,167 B1 * 10/2001 Kajio et al. ..... 200/43.11
6,373,004 B1 * 4/2002 Jackson ..... 200/50.1
6,407,353 B1 * 6/2002 Fritzinger et al. ..... 200/334
6,483,053 B1 * 11/2002 Kajio et al. ..... 200/43.07
6,483,058 B1 * 11/2002 Ehrensberger ..... 200/302.2
6,720,508 B1 * 4/2004 Moriyama et al. ..... 200/200
6,861,597 B1 * 3/2005 Baechle ..... 200/43.04
6,872,898 B1 * 3/2005 Mohtasham ..... 200/43.01

FOREIGN PATENT DOCUMENTS

JP 63-285792 11/1988

* cited by examiner

*Primary Examiner*—Kyung S. Lee
*Assistant Examiner*—Lisa Klaus
(74) *Attorney, Agent, or Firm*—Harness, Dickey & Pierce, PLC

(57) ABSTRACT

A wireless device to be mounted on a license plate of an automobile is composed of a casing, components contained in the casing and an operating member inserted into the casing. A battery for supplying power to the components is selectively turned on or off by controlling an insertion depth of the operating member into the casing. At an initial depth, the power supply is turned on for testing the wireless device at a manufacturing plant. At an intermediate depth, the power supply is turned off to save energy consumption in periods of transportation or storage. At a final depth, the power supply is finally turned on for actual use of the wireless device, and the casing is hermetically closed by the operating member.

8 Claims, 4 Drawing Sheets

WIRELESS DEVICE HAVING A BATTERY SELECTIVELY ACTIVATED

CROSS-REFERENCE TO RELATED APPLICATION

This application is based upon and claims benefit of priority of Japanese Patent Application No. 2004-294738 filed on Oct. 7, 2004, the content of which is incorporated herein by reference.

BACKGROUND OF THE INVENTION

1. Field of the Invention

The present invention relates to a wireless transmitter-receiver device in which electric power is selectively supplied from a battery to wireless circuits.

2. Description of Related Art

Recently, an automobile license plate on which a wireless device is mounted for wirelessly transmitting a license number and a vehicle identification number (a so-called smart plate) has been proposed. The wireless device is always exposed to water splash, sunshine or other hazardous atmosphere. Therefore, the wireless device including a battery for supplying power to wireless circuits has to be contained in a hermetically encapsulated casing. When the battery is contained in such a casing, it is impossible to connect or disconnect the battery to the wireless circuits (referred to as activation of the battery) from outside. Accordingly, the encapsulated battery has to be continuously kept activated after the wireless device is manufactured in a device manufacturer.

A considerably long period of time is required after the wireless device is manufactured until it is actually used. If the battery is continuously kept activated, battery power is consumed in vain. Usual processes in this period are as follows. The wireless device is inspected after completion of the manufacturing processes. The battery has to be activated for performing the inspection. Then, the wireless device is shipped to a license plate manufacturer to be mounted on the license plate. The battery has to be activated to store a vehicle identification number and a license number in a memory included in the wireless device. Then, the license plate on which the wireless device is mounted is sent to a place, such as a transportation authority, where the license plate is mounted on a vehicle. The battery has to be activated to store information regarding security or the like in the memory. Then, the vehicle is delivered to a user, and the wireless device is put into actual use. After that, the battery has to be continuously kept activated. However, it is not necessary to keep the battery activated in periods of transportation or waiting time between processes. Rather, it is most desirable to keep the battery inactivated to save battery power consumption.

Power saving of this sort is required not only in the wireless device for the license plate but in other devices which are put into actual use a considerably long time after they are manufactured.

SUMMARY OF THE INVENTION

The present invention has been made in view of the above-mentioned problem, and an object of the present invention is to provide a wireless device having a battery, wherein the battery is activated only when necessary to save power consumption.

A wireless device such as a transmitter-receiver device mounted on a license plate of an automobile includes a battery for supplying power to a wireless circuit included in the device. A substrate, on which components such as a wireless circuit, a memory for storing a vehicle identification number and a license number, and a switch for turning on and off power supply from the battery to the wireless circuit, is contained in a casing. A member for operating the switch is inserted into the casing, and the switch is turned on or off according to an insertion depth of the operating member.

The operating member includes a rod member inserted into the casing and an end disk integrally connected to the rod member. The rod member has a depression in which a pivoting member of the switch is accommodated to thereby turn off the switch when the operating member is inserted into the casing up to an intermediate depth. When the operating member takes depths, including an initial depth and a final depth, other than the intermediate depth, the switch is turned on to supply power from the battery to the wireless circuit. In other words, the power supply to the wireless circuit is turned on at the initial depth (a shallow depth), turned off at the intermediate depth and turned on again at the final depth. When the operating member is inserted into the casing up to the final depth, the end disk connected to the end of the rod member hermetically closes the casing so that the components of the device are protected from water splashes or the like.

A second depression may be additionally formed on the rod member, so that the switch is turned off again when the pivoting member is accommodated in the second depression. In this case, the switch is operated in a sequence of on, off, on, off and on according to the insertion depth of the operating member. A sealing member may be included in the end disk so that the casing is hermetically sealed when the operating member is inserted into the casing up to the final depth. A removable spacer may be disposed between the end disk and the casing so that the operating member is kept at a certain depth, e.g., at the intermediate depth. An anchoring portion engaging with the pivoting member may be formed in the depression so that the operating member is not able to be pulled back from the position where the pivoting member is accommodated in the depression.

According to the present invention, the battery power of the wireless device is prevented from being consumed in vain in periods of transportation or storage. The battery can be activated or inactivated (power supply is turned on or off) by simply controlling the insertion depth of the operating member. Other objects and features of the present invention will become more readily apparent from a better understanding of the preferred embodiment described below with reference to the following drawings.

DETAILED DESCRIPTION OF THE PREFERRED EMBODIMENT

Figure 1:
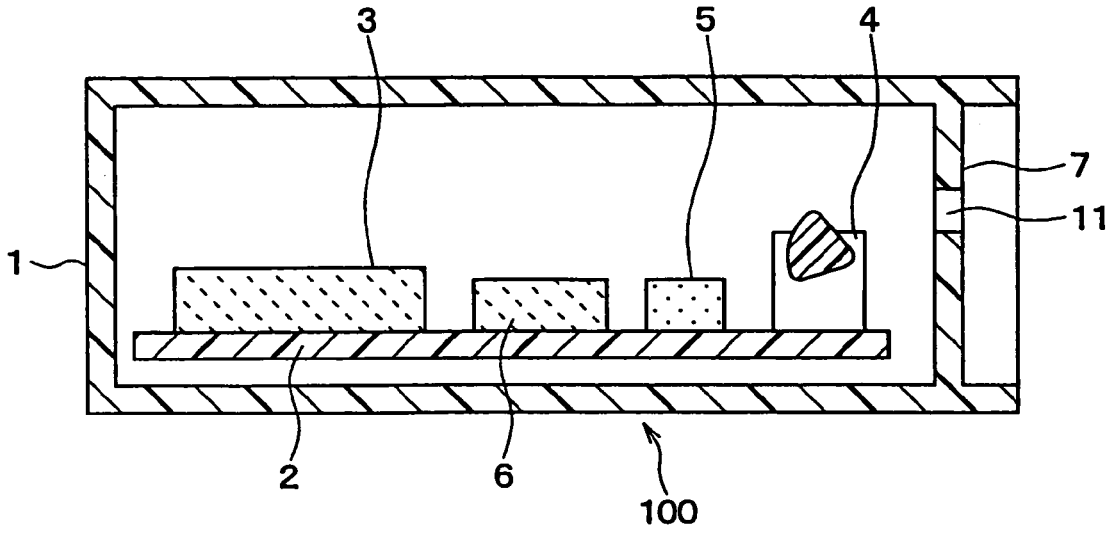
FIG. 1 is a cross-sectional view showing a wireless device to be mounted on a license plate.

A first embodiment of the present invention will be described with reference to FIGS. 1–4. A wireless device 100 is mounted on a license plate of an automobile or installed in the vicinity of the license plate. The wireless device 100 is shaped in a rectangular box (e.g., 40 mm×40 mm×15 mm). FIG. 1 shows a cross-sectional view, assuming that the left side in FIG. 1 is the front side of the wireless device 100. The wireless device 100 wirelessly transmits information such as a license number and a vehicle identification number to a roadside device.

Components of the wireless device 100 are contained in a casing 1. A wireless circuit 3, a memory 6, a battery 5 and a switch 4 mounted on a substrate 2 are all contained in the casing 1. The casing 1 is made of a resin or metallic material. At the rear end of the casing 1, a hole 11 (e.g., 2 mm square) and a depressed portion 7 surrounding the hole 11 are formed. The depressed portion 7 is cylinder-shaped (viewed from the rear side of the casing 1) with a diameter of about 10 mm and a depth of about 5 mm. The hole 11 is positioned at a little eccentric position with respect to a center of the round depressed portion 7. The casing 1 is structured to hermetically protect components contained therein.

The memory 6 is composed of a rewritable non-volatile memory such as a flash memory, and data are stored in the memory 6 and read out under control of the wireless circuit 3. The substrate 2 is fixedly connected to the casing 1 with screws or the like. The wireless circuit 3 performs various functions such as amplification, modulation, de-modulation, D/A conversion and A/D conversion. Data are stored in the memory 6 and the stored data are transmitted to outside devices through an antenna (not shown) under control of the wireless circuit 3. Operating power is supplied from the battery 5 to the wireless circuit 3.

Figure 2:
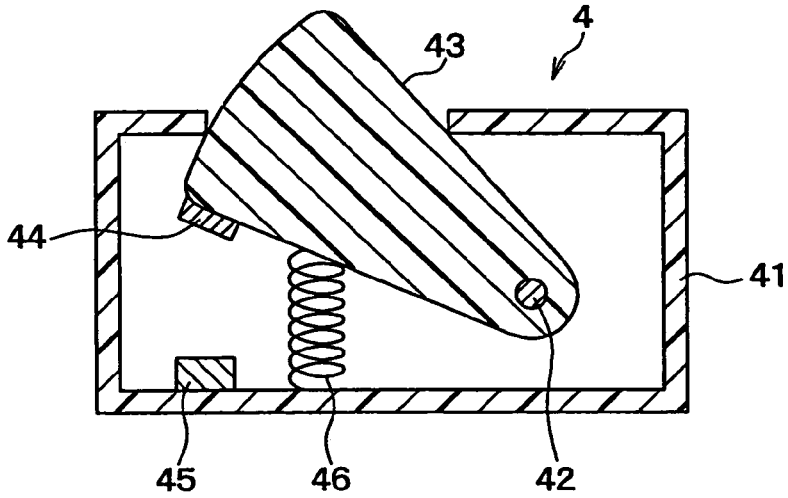
FIG. 2 is a cross-sectional view showing a switch (OFF state) used in the wireless device, in an enlarged scale.

Power supply from the battery 5 to the wireless circuit 3 is turned ON or OFF by the switch 4. As shown in FIG. 2, the switch 4 is composed of a switch case 41, a shaft 42, a pivoting member 43, a movable contact 44, a stationary contact 45, and a spring 46. The switch case 41 is a box-shaped member made of a resin material, and is fixedly mounted on the substrate 2. An upper surface of the switch case 41 and the lower surface of the hole 11 are positioned at the same level. An opening is formed in the upper surface of the switch case 41 so that a portion of the pivoting member 43 is able to expose, and a shaft 42 supporting the pivoting member 43 is fixed to the switch case 41. The pie-shaped pivoting member 43 pivots around the shaft 42.

The movable contact 44 is fixed to the pivoting member 43, as shown in FIG. 2, and the stationary contact 45 is fixed to a bottom wall of the switch case 41, so that both contacts 44, 45 are closed or opened according to movement of the pivoting member 43. When the contacts 44, 45 are closed, electric power is supplied from the battery 5 to the wireless circuit 3 (this situation is referred to as "the battery is activated" in this specification). On the other hand, when the contacts 44, 45 are opened, power supply is discontinued (the battery is inactivated).

Figure 3:
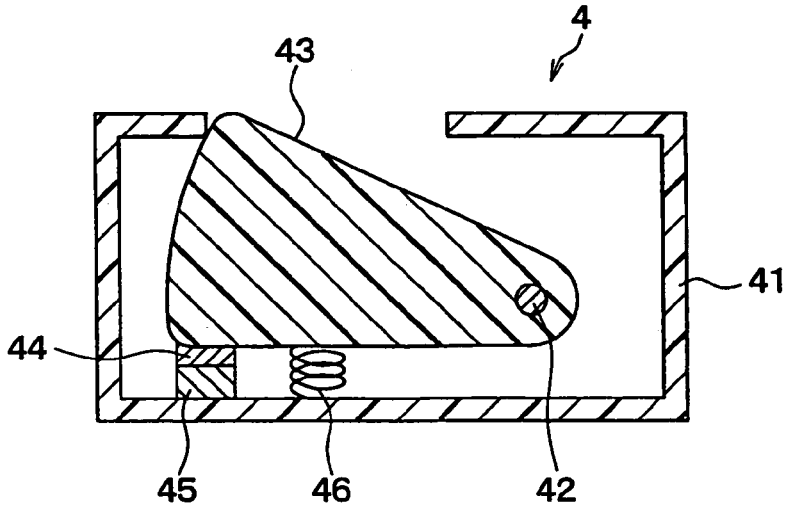
FIG. 3 is a cross-sectional view showing the switch (ON state)

The pivoting member 43 is biased upward by the spring 46, so that an upper portion of the pivoting member 43 exposes from the opening of the switch case 41, as shown in FIG. 2. The pivoting member 43 does not move upward beyond the position shown in FIG. 2 because the pivoting member 43 abuts the edge of the opening. When the pivoting member 43 is pushed downward, the pivoting member 43 moves downward against the biasing force of the spring 46, and the contacts 44, 45 are closed, as shown in FIG. 3.

Figure 4:
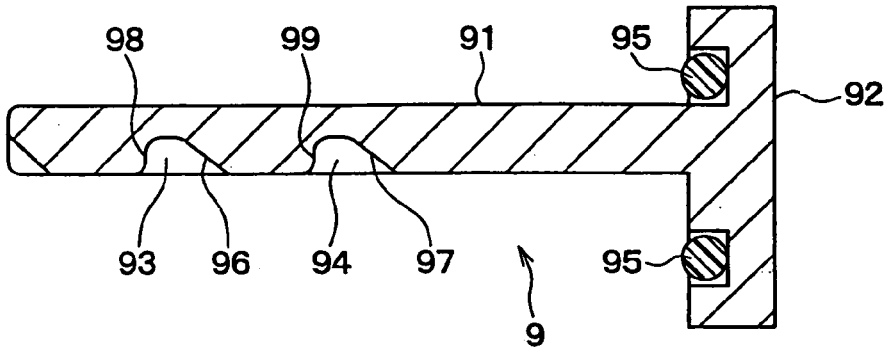
FIG. 4 is a cross-sectional view showing an operating member used in the wireless device.

An operating member 9 shown in FIG. 4 is inserted into the casing 1 through the hole 11, so that the pivoting member 43 is operated to close or open the contacts 44, 45 according to a depth of insertion. The operating member 9 is made of a resin or metallic material and is composed of a rod member 91 and an end disk 92 connected to the rod member 91. The rod member 91 has a square cross-section corresponding to the square shape of the hole 11. The end disk 92 has a round circumference corresponding to the round shape of the depressed portion 7.

On the lower surface of the rod portion 91, depressions 93, 94 are formed as shown in FIG. 4. Each depression 93, 94 has a sufficient size to accommodate the upper portion of the pivoting member 43 therein (refer to FIG. 5B). Each depression 93, 94 has an anchoring portion 98, 99 engaging with the pivoting member 43 and a sloped surface 96, 97. The anchoring portion 98, 99 stands up from the bottom surface of the rod member 91 at an about right angle, and the sloped surface 96, 97 is formed to make an angle of about 30 degrees with respect to the bottom surface of the rod member 91. An O-ring 95 for sealing is disposed, surrounding a foot portion of the rod member 91, in a groove formed on the end disk 92.

Figure 5A:
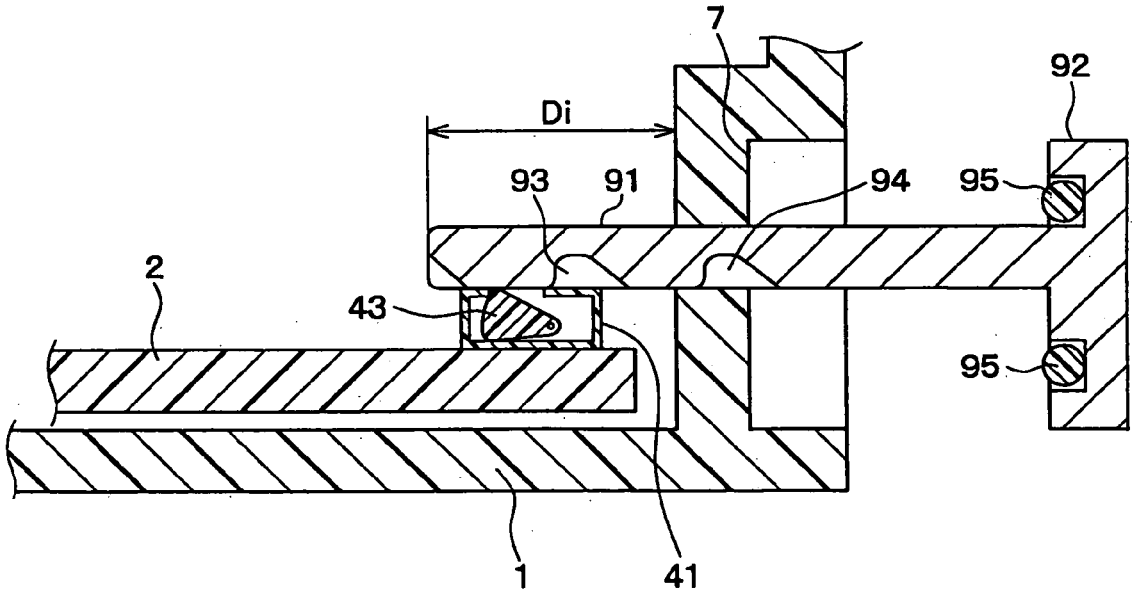
FIG. 5A is a partial cross-sectional view showing the wireless device, in which the operating member takes a first position.
Figure 5B:
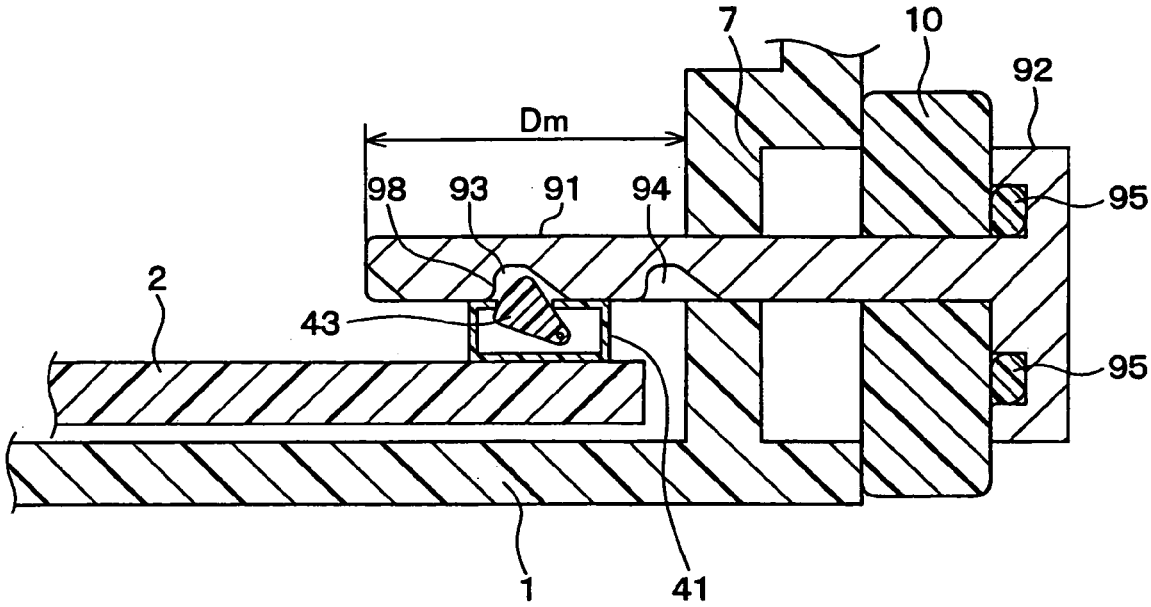
FIG. 5B is a partial cross-sectional view showing the wireless device, in which the operating member takes a second position.
Figure 5C:
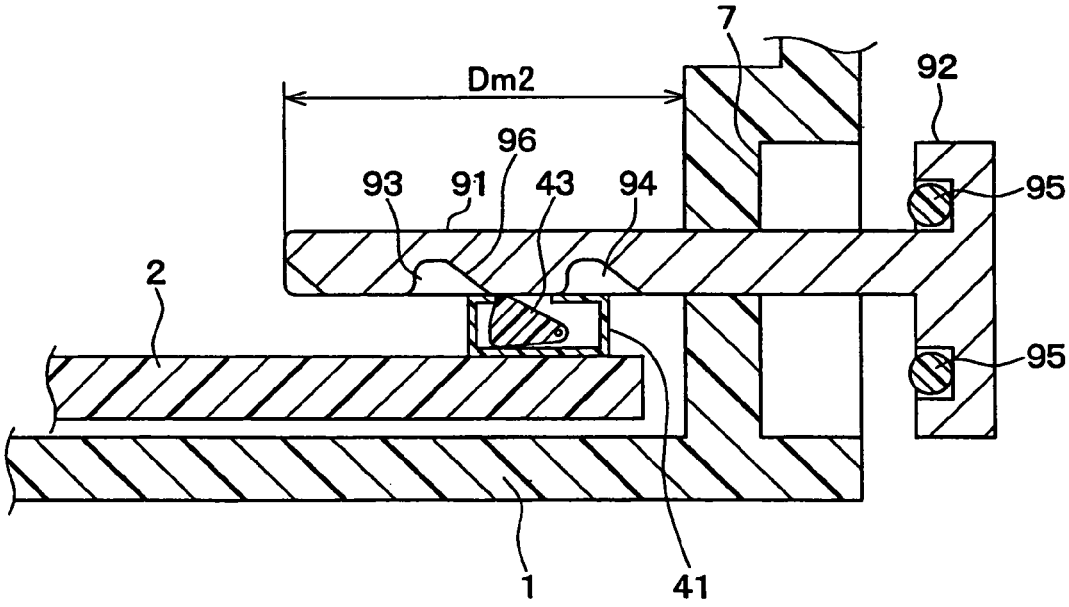
FIG. 5C is a partial cross-sectional view showing the wireless device, in which the operating member takes a third position.
Figure 5D:
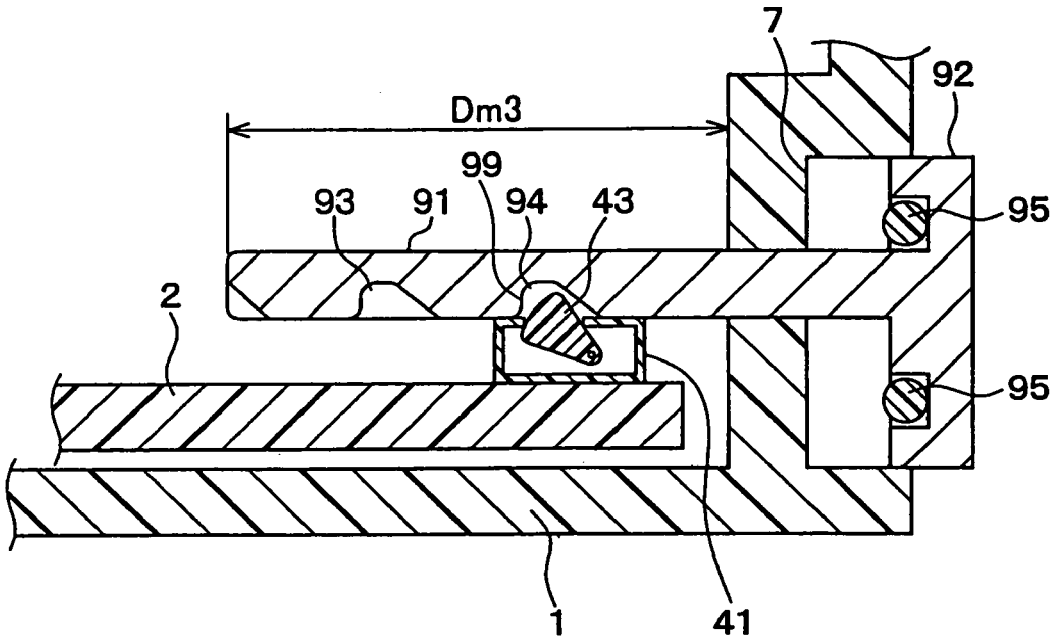
FIG. 5D is a partial cross-sectional view showing the wireless device, in which the operating member takes a fourth position.
Figure 5E:
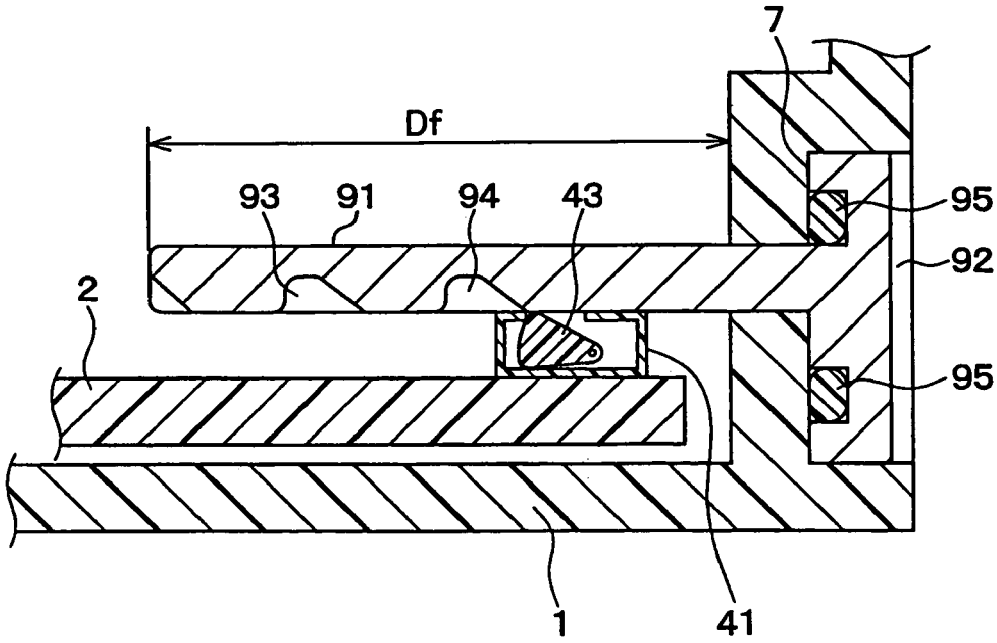
FIG. 5E is a partial cross-sectional view showing the wireless device, in which the operating member takes a fifth position.

Processes of handling the wireless device 100 after it is manufactured and until it is put into actual use will be explained with reference to FIGS. 5A–5E. As shown in FIG. 5A, for testing operation of the wireless device 100 after it is manufactured, the operating member 9 is inserted into the casing 1 so that it takes an initial depth Di. At this depth Di, the pivoting member 43 is pushed downward by the rod member 91, and the contacts 44, 45 are closed, thereby supplying electric power from the battery 5 to the wireless circuit 3 (the battery is activated). The test is performed by activating the battery 5 in this manner.

Then, the wireless device 100 is shipped to a license plate manufacturer to mount the wireless device 100 on the license plate. Before shipping the wireless device 100, the operating member 9 is further inserted into the casing 1 up to an intermediate depth Dm shown in FIG. 5B. The operating member 9 is inserted by pushing the end disk 92 with a finger. At this depth Dm, the pivoting member 43 moves up into the depression 93 by the biasing force of the spring 46. The contacts 44, 45 are opened and the battery 5 is inactivated. Power consumption of the battery during a period of transportation is saved in this manner. If the operating member 9 is pulled back toward the rear side when the operating member 9 is positioned at the intermediate depth Dm, the operating member 9 does not move toward the rear side because the anchoring portion 98 engages with the pivoting member 43 that cannot move beyond the present position. A U-shaped spacer 10 may be inserted between the end disk 92 and the casing 1 so that the operating member 9 is prevented from moving further toward the front side.

After the wireless device 100 arrived at the license plate manufacturer, the wireless device 100 is mounted on the license plate. The battery 5 has to be activated to memorize the vehicle identification number and the license plate number in the memory 6 of the wireless device 100. The operating member 9 is further inserted up to a second intermediate depth Dm2 shown in FIG. 5C after removing the spacer 10. At this second intermediate depth Dm2, the pivoting member 43 is pushed downward by the rod member 91 to thereby close the contacts 44, 45. Thus, the battery 5 is activated. When the operating member 9 is moved from the intermediate position Dm shown in FIG. 5B to the second intermediate position Dm2 shown in FIG. 5C, its movement is smooth because the pivoting member 43 easily moves out from the depression 93 along the sloped surface 96 which is not steep.

Then, the wireless device 100 is transferred to a place where the license plate with the wireless device 100 is mounted on a vehicle. Before the transportation, the battery 5 is inactivated. The operating member 9 is further pushed into the casing 1 up to a third intermediate depth Dm3 shown in FIG. 5D. At the third intermediate position Dm3, the pivoting member 43 is accommodated in the depression 94 by the biasing force of the spring 46 to thereby open the contacts 44, 45. At this depth Dm3, the operating member 9 becomes impossible to be pulled back in the same manner as at the intermediate depth Dm shown in FIG. 5B. Power consumption in the battery 5 is saved during the transportation in this manner.

After the license plate with the wireless device 100 arrived at the place where the license plate is mounted on the vehicle, the battery 5 has to be activated again for memorizing security information or the like in the memory 6. The operating member 9 is inserted up to a final depth Df shown in FIG. 5E. At the final depth Df, the pivoting member 43 is pushed by the rod member 91 to thereby close the contacts 44, 45. The end disk 92 is completely contained in the depressed portion 7 of the casing when the operating member 9 takes the final position Df. The O-ring 95 surrounding the foot portion of the rod member 91 is compressed between the bottom wall of the depressed portion 7 and the end disk 92, so that the hole 11 is hermetically sealed. Since the end disk 92 is entirely accommodated in the depressed portion 7, it becomes difficult to pull back the operating member 9 from the casing 1. After the above process is completed, the operating member 9 is kept at the final position Df to put the wireless device 100 into actual use, while hermetically sealing the wireless device 100.

As described above, the battery 5 is kept not to consume its power in vain during the period after completion of manufacture and until it is actually used. This is realized by inserting the operating member 9 into the casing 1 stepwise. The wireless device 100 is hermetically sealed by the O-ring 95 when the operating member 9 is inserted up to the final depth Df. Further, the stepwise insertion of the operating member 9 is easily done because the depressions 93, 94 are discretely formed.

The present invention is not limited to the embodiment described above, but it may be variously modified. For example, the depressions 93, 94 may be replaced with a single depression if such is suitable for actual handling processes of the wireless device 100. The square cross-section of the rod member 91 may be replaced with other cross-sections such as a triangular cross-section as long as the pivoting member 43 is operated according to the insertion depth of the operating member 9. The depressed portion 7 may be formed in other shapes. For example, it may be made in a tapered shape open to the outside and connected to the hole 11 so that the hole 11 is well sealed when the operating member 9 takes the final position Df. The O-ring 95 may be replaced with a sealing member such as a gasket. A projection may be formed on the end disk 92 to ease operation of the operating member 9, and the projection may be removed after the operating member 9 is inserted up to the final depth Df.

The switch 4 may be structured differently. For example, the pivoting member 43 may be connected to the rod member 91 and the contacts may be separately positioned on the substrate 2. Though the switch 4 is structured so that the battery is inactivated when the pivoting member 43 is accommodated in the depressions 93, 94 in the foregoing embodiment, it is possible to inactivate the battery when the pivoting member 43 is pushed out of the depressions 93, 94. Though the removable spacer 10 is used when the operating member 9 takes the intermediate position Dm in the foregoing embodiment, it is possible to use another spacer which is thinner than the spacer 10 when the operating member 9 takes the third intermediate position Dm3. Alternatively, the U-shaped spacer 10 may divided into two spacers in the thickness direction, so that two spacers are used in the position Dm and one spacer is removed in the position Dm3.

While the present invention has been shown and described with reference to the foregoing preferred embodiment, it will be apparent to those skilled in the art that changes in form and detail may be made therein without departing from the scope of the invention as defined in the appended claims.

What is claimed is:

1. A wireless device comprising:

a casing;

a wireless circuit contained in the casing;

a battery, contained in the casing, for supplying power to the wireless circuit;

a switch, contained in the casing, for turning on and off power supply from the battery to the wireless circuit;

a member for operating the switch by controlling an insertion depth of the operating member into the casing, so that the switch is turned on when the operating member is inserted into the casing up to an initial depth, turned off when the operating member is inserted into the casing up to an intermediate depth and turned on again when the operating member is inserted into the casing up to a final depth, the casing being hermetically closed by the operating member when the operating member is inserted into the casing up to the final depth.

2. The wireless device as in claim 1, wherein:

the operating member is completely encompassed in the casing when the operating member is inserted up to the final depth.

3. The wireless device as in claim 1, wherein:

the operating member includes a rod member to be inserted into the casing and an end disk connected to the rod member, and the end disk is entirely contained in a depressed portion formed in the casing when the operating member is inserted into the casing up to the final depth.

4. The wireless device as in claim 3, wherein:

the operating member further includes a sealing member surrounding a portion connecting the rod member to the end disk, and the sealing member closely contacts the depressed portion when the operating member is inserted into the casing up to the final depth.

5. The wireless device as in claim 3, wherein:

the wireless device includes a removable spacer to be disposed between the depressed portion and the end disk of the operating member when the operating member is inserted into the casing up to the intermediate depth, the removable spacer being removed to further insert the operating member into the casing from the intermediate depth to the final depth.

6. The wireless device as in claim 3, wherein:

the switch includes a pivoting member;

the rod member includes a depression in which the pivoting member is accommodated to thereby turn off the switch when the operating member is inserted into the casing up to the intermediate depth; and the pivoting member is pushed back by the rod member, coming out of the depression, to thereby turn on the switch when the operating member takes depths in the casing other than the intermediate depth.

7. The wireless device as in claim 6, wherein:

the depression of the rod member includes an anchoring portion that engages with the pivoting member to thereby prevent the operating member positioned at the intermediate depth from being pulled back toward a position of the initial depth.

8. The wireless device as in claim 6, wherein:

the rod member further includes a second depression in which the pivoting member is accommodated to turn off the switch when the operating member is inserted into the casing up to a third intermediate depth which is deeper than the intermediate depth and shallower than the final depth; and the pivoting member is pushed back by the rod member to thereby turn on the switch when the operating member takes a second intermediate depth which is between the intermediate depth and the third intermediate depth.

* * * * *